United States Patent [19]

Palkovic

[11] 4,138,934

[45] Feb. 13, 1979

[54] ENVELOPE FORMING ASSEMBLIES

[75] Inventor: Victor Palkovic, Westchester, Ill.

[73] Assignee: Garden City Envelope Company, Chicago, Ill.

[21] Appl. No.: 802,249

[22] Filed: May 31, 1977

[51] Int. Cl.[2] ..... B31B 21/02

[52] U.S. Cl. ..... 93/63 R

[58] Field of Search ..... 93/61 R, 61 AC, 62, 93/63 R; 271/2

[56] References Cited

U.S. PATENT DOCUMENTS

| | | | |
|---|---|---|---|
| 3,685,402 | 8/1972 | Ehlscheid | 93/61 R |
| 3,710,694 | 1/1973 | Ehlscheid | 93/62 |
| 3,896,712 | 7/1975 | Ehlscheid | 93/61 AC |

*Primary Examiner*—Howard N. Goldberg
*Assistant Examiner*—Paul A. Bell
*Attorney, Agent, or Firm*—Neuman, Williams, Anderson & Olson

[57] ABSTRACT

An assembly is provided of a known high speed envelope blank cutting unit with a known envelope folding unit and an envelope conveyor to transport a continuous stream of envelope blanks from the blank cutting unit to the folding unit in a predetermined timed sequence and in position for proper entry into the folding unit. The conveyor includes predetermined transport segments positioned, relative to one another, to accommodate necessary path direction changes, and a stacking or shingler segment. Opposed belt systems in each transport segment maintain the blanks in a desired relative relation. The belts are driven from the blank cutting unit, with each transport segment driven by or driving adjacent segments. The timing between the blank cutting unit, the folding unit, and the envelope conveyor is selected and adjusted through an adjustable drive shaft arrangement interconnecting the two units.

15 Claims, 7 Drawing Figures

ENVELOPE FORMING ASSEMBLIES

BACKGROUND OF THE INVENTION

This invention relates to machines for forming envelopes and more particularly to assemblies or combinations of high speed blank cutting units, envelope folding machines, and associated conveyors which interconnect the units and assure that envelope blanks are transported to the folder unit in proper positional relation. This invention permits the mating of known high speed cutters and known rotary folding machines to obtain assemblies and operating flexibilities and advantages not heretofore available.

In modern envelope operations, different units which perform separate functions are frequently combined to form a single machine capable of performing a number of functions in one continuous operation. More specifically, it is frequently advantageous to combine a high speed, continuous paper web blank cutting unit with an envelope forming or folding unit which has no blank cutting capability. This alleviates the time consuming and wasteful need for die cutting envelope blanks from sheets of paper and manually stacking the blanks in position for entry into the envelope forming unit. In addition, such a combination allows for the continued use of pre-existing folding machines, which are very complex and expensive, while thereby enhancing the utility and flexibility of such units. However, because some envelope folding units have their blank entry point at a position intermediate either end, it has been difficult to combine such a unit with the more desirable high speed, continuous blank cutting unit. In particular, such a link between a "High Speed Rotary Diagonal Web Attachment", model HD, and a Rotary Window Envelope Forming unit, Model RW, each manufactured by F. L. Smithe Machine Compay of Duncansville, Pennsylvania, was not accomplished in the past apparently because of such limitations.

Simultaneously with transporting blanks to the entry point of such a mid-entry envelope forming unit, it is frequently necessary that the blanks arrive at the unit entry point within a predetermined time sequence and at a high feed rate. These requirements necessitate accurate positional maintenance of the blanks as they leave the cutting unit, travel to, and arrive at the envelope forming unit entry point. While assuring positional blank relation along the conveyor path, path direction modification must be accomplished without wrinkling, scuffing or otherwise marring the envelope blanks.

To achieve the cutting of blanks and forming of envelopes in a high speed environment, accurate coordination of the cycling of such joined units must be achieved. As such, the operation of an envelope conveyor for interconnecting or "marrying" cutting and forming units must be coordinated with both units being interconnected.

OBJECTS OF THE INVENTION

It is an object of this invention to provide for conjoint use of previously known high speed envelope blank cutters with known envelope forming machines.

It is a further object of this invention to provide for use of high speed rotary diagonal web envelope blank cutters such as the aforenoted Model HD machine with envelope forming machines such as the aforenoted RW machine.

It is an object of the present invention to provide an improved, low cost, and simplified envelope conveyor for transporting envelope blanks between individually functioning units of envelope machine assemblies.

It is another object of this invention to provide an envelope conveyor which positively transports envelope blanks while allowing for path directional changes without marring, scuffing or otherwise defacing the envelope blanks carried therein.

It is still another object of this invention to provide an envelope conveyor which includes predetermined segments which may be positioned to accommodate path directions changes, with each segment driven by or driving adjacent segments.

SUMMARY OF THE INVENTION

The foregoing objects are achieved, according to an illustrative embodiment of the invention, by an envelope conveyor which links a continuous paper web envelope blank cutter unit with a second continuous operation mid-entry blank forming unit. The conveyor includes an elevated transport portion and shingling portion which carry a plurality of envelope blanks from the cutter to the folding unit, while maintaining the blanks at predetermined intervals and in position for proper entry into the folding unit. The operation of the blank cutter, folding unit, and envelope conveyor are coordinated so that the movement and position of each blank produced by the blank cutter and in transit to the folding unit may be accurately regulated and/or adjusted.

In one particular embodiment of the invention illustrated herein, three transport segments and a bridge or shingler segment are combined to form the envelope conveyor and are positioned, relative to each other, to link the exit point on the blank cutter unit with the mid-entry point on an envelope forming unit. Opposed belts, mounted on each transport segment, positively move the stream of envelope blanks therethrough and drive or are driven by adjacent transport segment belts. The envelope blank path along a given transport segment is slightly sinusoidal so that positive drive contact with each blank can be assured along the length of each segment. Where two transport segments join and extend angularly from one another, positive contact between each blank and the belts is maintained only along the leading and trailing ends of each blank. As such, the direction of movement may be altered without smudging or otherwise defacing the blanks by scuffing.

The transport segments are driven from the blank cutting unit so that any spacing or overlapping between blanks can be initially set and maintained as the blanks move from the blank cutter. Adjacent to the last transport segment, the blanks are further overlapped or shingled as they make the transition to the inclined bridge segment, prior to their entry into the envelope forming machine. The blanks are shingled along the inclined bridge, which is driven from the envelope forming unit, so that accurate blank entry sequencing can be accomplished. The transport and bridge segments' operation is coordinated through a drive shaft that extends between the two units and which is calibrated to assure accurate and coordinated machine cycling relationships, which in turn determines the feeding relationship of the blanks.

Other objects, advantages and features of the invention will become apparent upon reading the following detailed description and appended claims, and upon reference to the accompanying drawings.

For a complete understanding of this invention, reference should now be had to the embodiment illustrated in greater detail in the accompanying drawings and described below by way of an example of the invention.

While the invention will be described in a connection with a preferred embodiment, it will be understood that it is not intended to limit the invention to that particular embodiment. On the contrary, it is intended to cover all alternatives, modifications and equivalents as may be included within the spirit and scope of the invention as defined by the appended claims.

Figure 1:
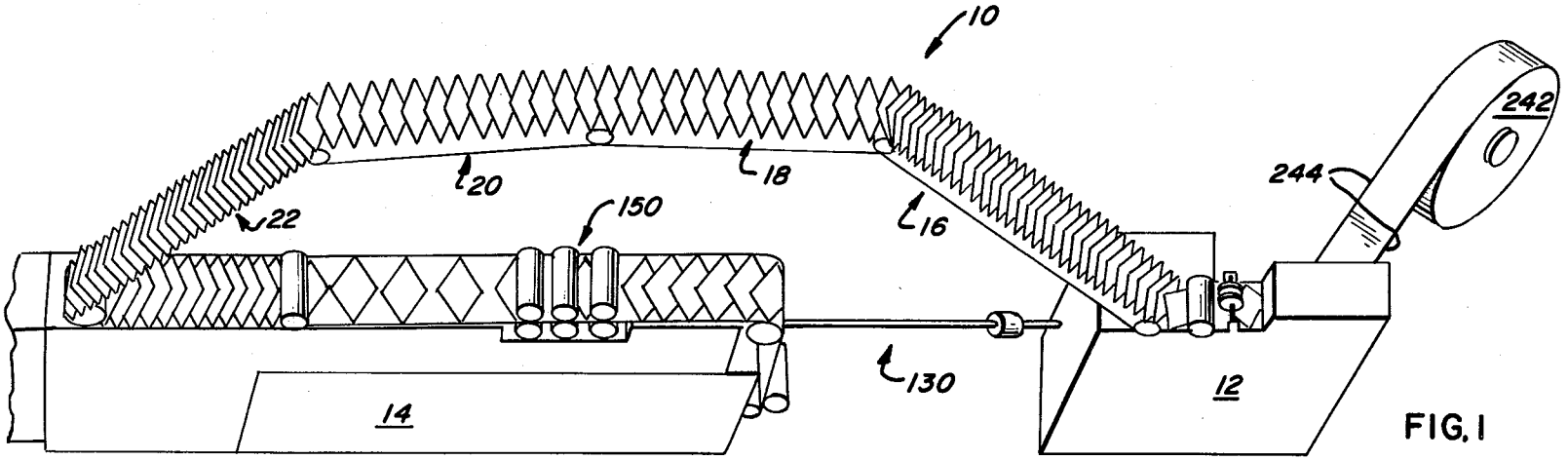
FIG. 1 is a schematic perspective view of the preferred embodiment of an envelope producing assembly employing teachings of this invention, showing a conveyor connected between a continuous web blank cutting unit and an envelope forming unit, and illustrating the positioning of envelopes therealong.

Turning now to the drawings, and principally FIG. 1, the preferred embodiment of an envelope forming assembly according to the invention is shown. A conveyor 10 is shown in place between a rotary high speed diagonal web-feed blank cutter 12 and a rotary window envelope forming unit 14. The envelope conveyor 10 includes three transport segments 16, 18, 20 (FIG. 2) connected together in series, and a shingling or bridging segment 22.

The transport segments include pairs of belts *24a–24b, 26a–26b* and *28a–28b*, respectively, each constructed of a plastic or rubberized material for gripping the blanks. Each belt is of an accurate timing belt configuration and of controlled uniform thickness to assure the maintenance of a desired paper transfer path between opposed belts. The belts are directed over a plurality of spaced pressure sprockets or rollers 30, take-up roller units 36, and drive sprocket rollers *38a–h* such that the belts in each transport segment will grip envelope blanks therebetween. Arrows A and B indicate the direction that each belt moves when the envelope conveyor 10 is operated. As shown in FIGS. 3, 4, 5 and 6, each belt *24a–24b, 26a–26b, 28a–28b* is a timing belt, being toothed or notched along the surface which engages the sprockets 30. The tooth configuration of the belts corresponds to the sprocket or cog surfaces of the rollers 30, *36a* and *38a–h*. The various rollers, sprockets and other components of the conveyor 10 are mounted on upper and lower transport frames such as frames 32, 34 of segment 18 shown in FIG. 4, which are part of a support framework 78 secured to the units 12 and 14 and extending therebetween. Frames 56, 58 of segment 16, and 124, 125 of segment 20 are also secured to the framework 78 (FIG. 4) which is comprised of two parallel beams straddling the conveyor 10.

Figure 6:
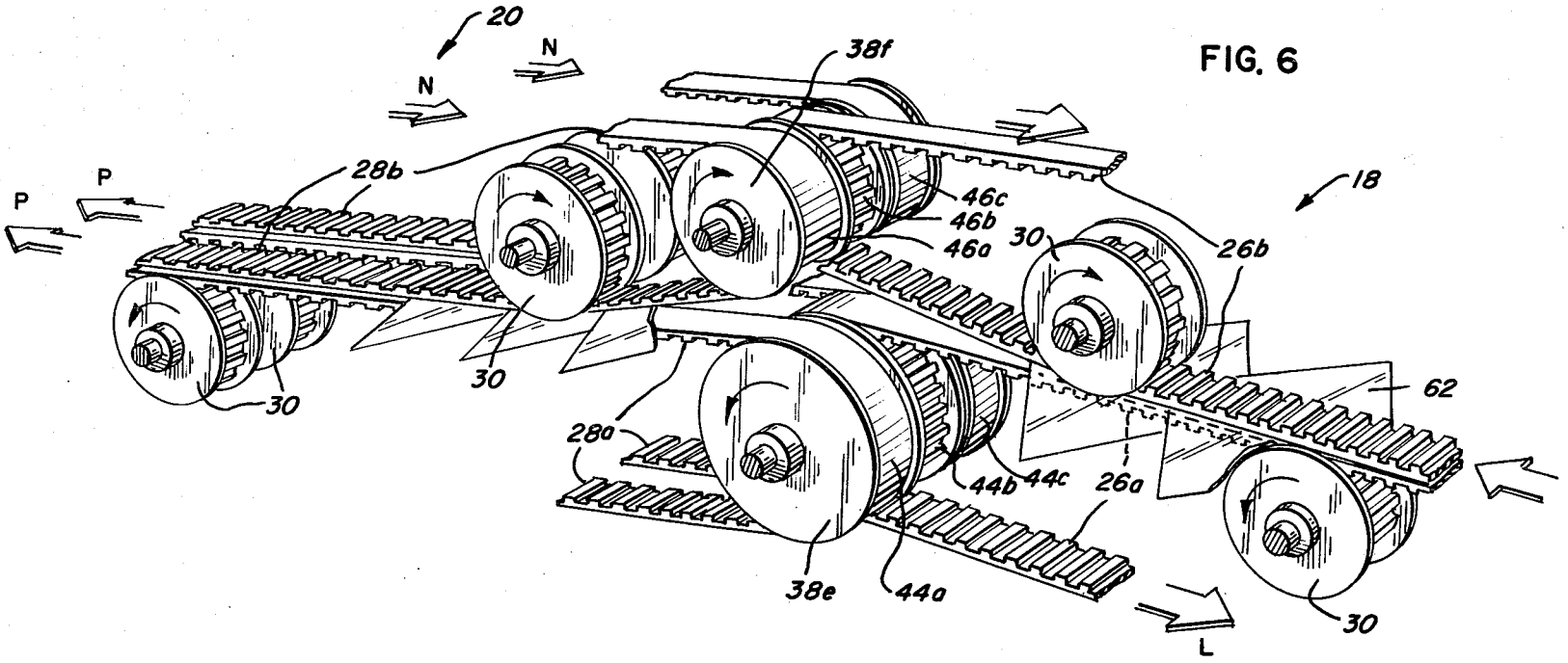
FIG. 6 is a fragmentary perspective schematic view of the envelope conveyor of FIG. 1 at the junction of the second and third transport segements and showing the relative disposition of certain blanks being conveyed therethrough with the clearance between the drive rollers exaggerated for illustrative purposes.

The upper and lower belts of each transport segment are driven from the blank cutter unit 12. This drive is effected by a direct drive from the cutter unit through a drive system (not shown) which turns drive shafts 40, 42 (FIG. 3) connected to respective upper and lower drive rollers *38b, 38a* in transport segment 16. The belts of segment 16 also serve as drive belts for segment 18, and the belts of segment 18 serve as drive belts to segment 20. To this end, the drive sprockets *38a–h* at the intersections of the segments are mounted on common shafts. With reference to FIG. 6, for example, the drive force (arrows L, M) is transmitted from transport segment 18 to an adjacent segment 20 (see arrows N, P) through drive rollers *38e* and *38f*. Each drive roller *38e, 38f* includes three belt sprocket channels, *44a–c* and *46a–c*, respectively. Each sprocket receives one belt running in either transport segment 18 or 20. Thus, the drive force is transmitted from opposed belts *26a, 26b* in transport segment 18 to opposed belt pairs *28a, 28b* in transport segment 20 through the rollers *38e* and *38f*, as belts *26a, 26b* move over these rollers.

Figure 4:
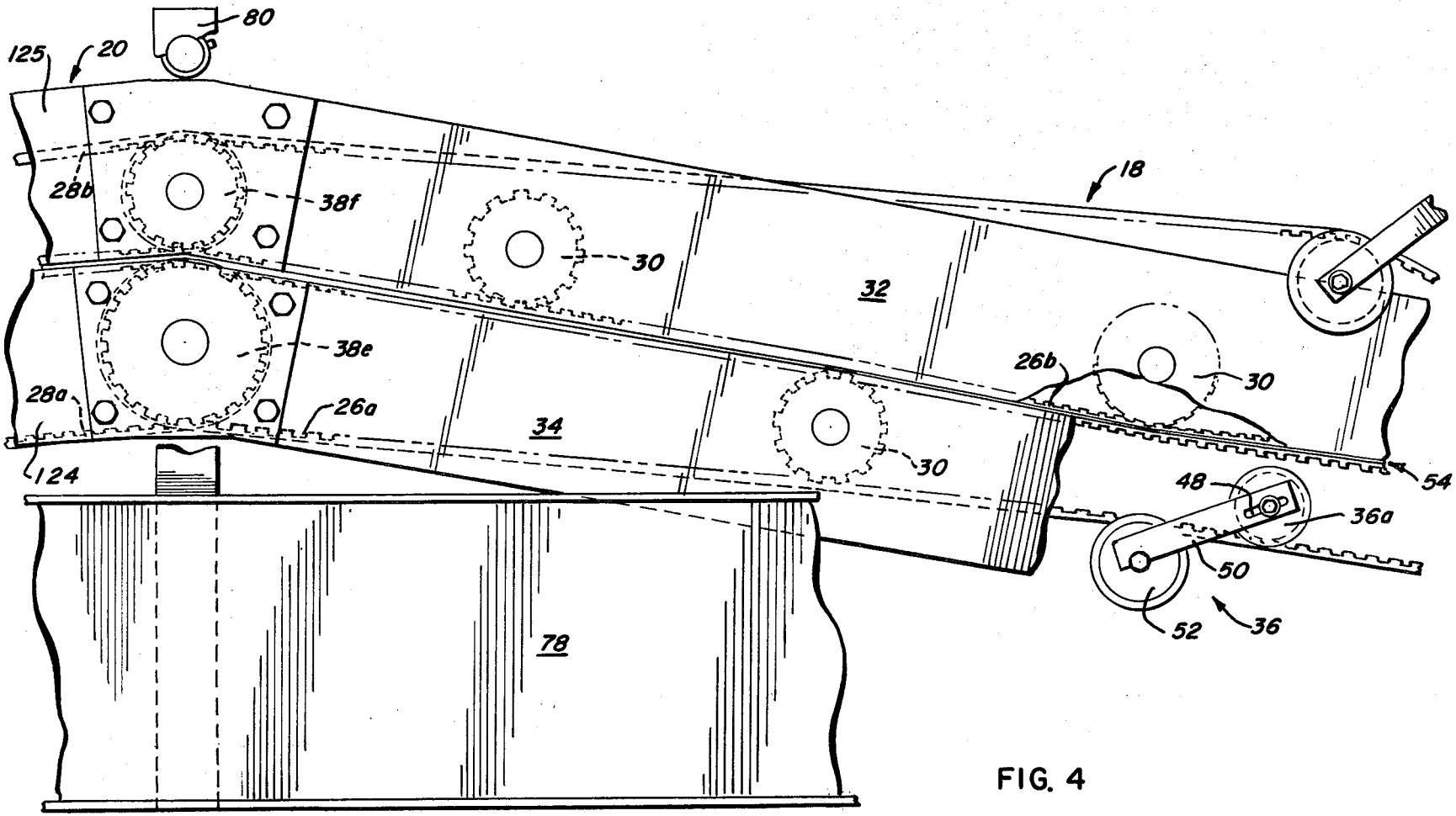
FIG. 4 is an enlarged fragmentary side elevational view of a portion of a second transport segment of the envelope conveyor shown at the junction with a third transport segment, and with portions thereof shown cut away.

To move envelope blanks swiftly and in precise relative position to one another, it is necessary to maintain positive contact between each blank and the opposed belt surfaces of each transport segment. As best shown in FIG. 4, positive contact between a blank and opposed belts, such as the belt pair *26a–26b*, is achieved in part by belt tension as regulated by the setting of take-up elements 36 mounted on upper and lower frames 32 and 34 along the return runs of the belts. A sprocket roller *36a* of each element 36 is manually movable along a slot 48 provided in support piece 50, which interconnects roller *36a* and smooth surfaced roller 52. The element 36 is fixedly attached to the transport frames 32, 34, and by securing roller *36a* along slot 48 to either lengthen or shorten the belt travel path, a desired tension may be set and maintained in belt *26a*.

To further assure positive blank-belt contact along any transport segment, pressure rollers 30 over which the respective opposed belts travel are disposed in staggered offset relation along the respective transport run or path of the segment. Thus the rollers 30 are located along upper and lower transport segment frames 32 and 34 such that a roller carried on one frame is positioned between two adjacent rollers on the opposite frame and will extend through an imaginary tangent line extending between adjacent rollers mounted on the opposite frame. Because rollers 30 are so positioned, the path of the opposed belt runs and thus the path of blank travel 54 will be slightly sinusoidal and thereby assure positive contact between the blanks and belts. The sinusoidal path will necessitate a slight path and therefore belt direction change whenever opposed belts *26a, 26b*, for example, pass over a roller 30. It is important to limit the amount of path direction change to prevent inadvertant scuffing or destruction of blanks being transported due to the change in velocity of the contact surface of each belt as it passes around a roller or sprocket for such a change of direction. That is, while the inner and outer surface of each belt are moving together and therefore at the same speed between successive rollers 30, the outer surface will accelerate slightly as it travels around a portion of the roller circumference to accomplish a change in direction. This is so because as the belt moves through a certain arc, the outer surface of the belt must have necessarily traveled further than the inner surface in a given time. If the amount of direction change is kept small, the acceleration of the outer belt surface which contacts the blanks will be insignificant and will not cause blanks to be scuffed or smudged as they travel over rollers 30.

The same belt surface acceleration phenomenon will occur where two adjacent transport segments 18 and 20, for example, join (FIGS. 4, 6), and respective belts 26*a*, 28*a* and 26*b*, 28*b* travel around drive rollers 38*e*, 38*f*. Blank path 54 will extend over a portion of the circumference of drive roller 38*e*, the extent of which depends upon the relative angular disposition of segments 18 and 20. Because the direction change is much greater, the likelihood of blank scuffing or smudging also is much greater at the drive rollers if positive contact between the opposed belts 26*a*, 26*b* and 28*a*, 28*b*, and each blank is maintained along the entire blank near the junction between adjacent transport segments 18 and 20. To avoid such scuffing, drive roller 38*f* is mounted on upper transport frame 32 (FIG. 4) so that belt 26*b* will separate from opposed belt 26*a* beyond the final pressure roller 30 of segment 18 preceding and adjacent to drive roller 38*f*. Dual belts 28*b*, in segment 20, which extend around drive roller 38*f* also remain separated from opposing belts 28*a* until passing over the first pressure rollers 30 adjacent to and succeeding drive roller 38*f*. As a result, the blanks are released from the grip of the belts as they traverse the angle change at the drive rollers. This will facilitate blank movement and direction change between transport segments while preventing blank scuffing, smudging and the like. Positive blank transport will be maintained, however, because as each blank is propelled from segment 18 and from the grip of belts 26*a*, 26*b*, it will simultaneously be caught between belts 28*a*, 28*b* on segment 20. Thus, the distance between the rollers 30 adjacent to and on opposite sides of drive rollers 38*e*, 38*f* is less than the span of a blank.

Figure 2:
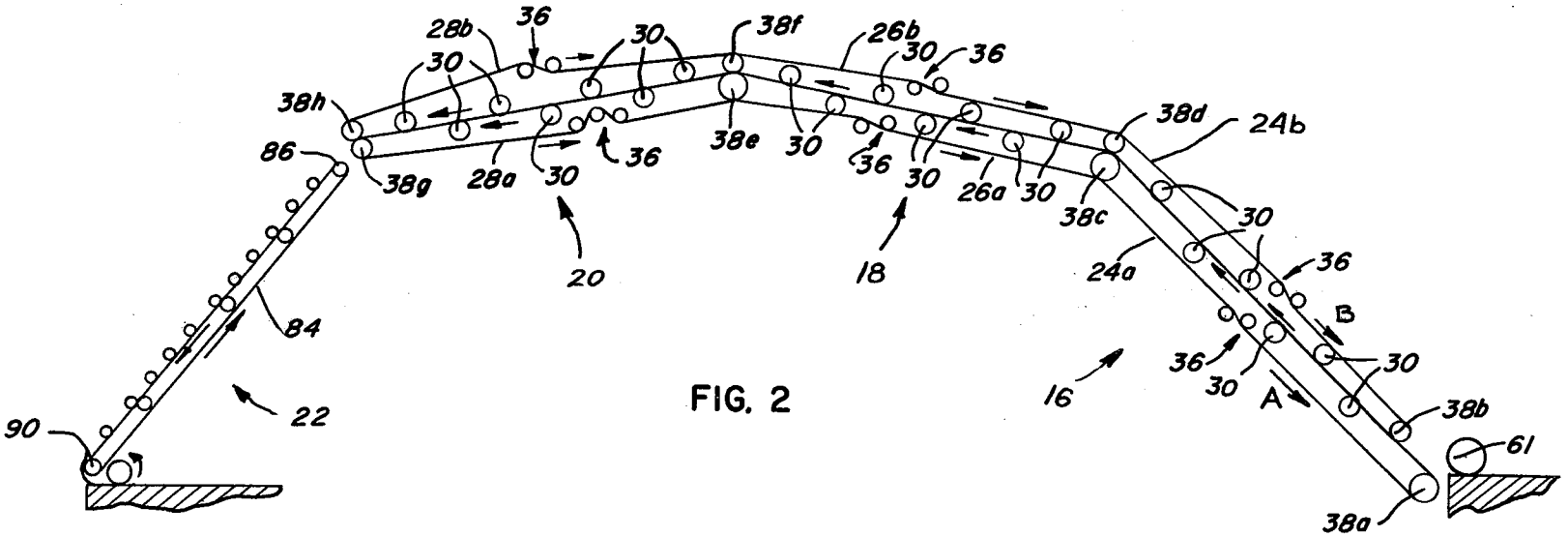
FIG. 2 is a schematic side elevational view of the envelope conveyor and associated parts of each unit as in FIG. 1.
Figure 3:
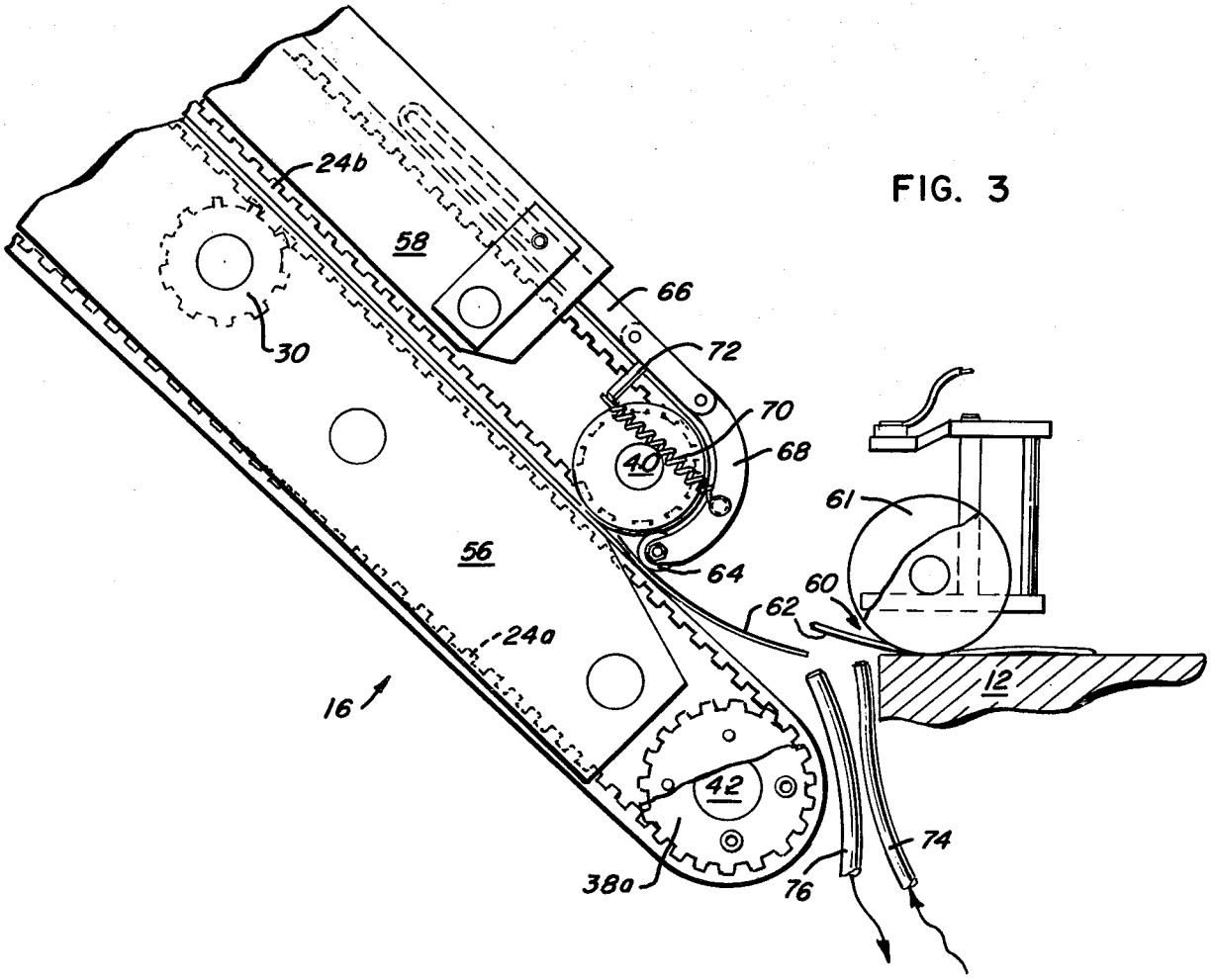
FIG. 3 is an enlarged fragmentary side elevational view of the output portion of the blank cutter and a portion of a first transport segment of the conveyor adjacent thereto, with portions thereof shown cut away.

Referring now to FIGS. 1, 2 and 3 the transition between blank cutter 12 and initial transport segment 16 is shown. The lower frame 56 of segment 16 extends beyond upper frame 58 to a position below the blank exit point 60 of cutter 12. Upper frame 58 terminates at a position above exit point 60, such that a blank 62 propelled from the final feed roller 61 of cutter 12 will contact belt 24*a* moving over drive roller 38*a* before moving between the opposed conveyor runs of the belts 24*a*, 24*b*. Each blank 62 is engaged under a gripping roller 64 as the blank contacts moving belt 24*a*. The gripping roller 64 is mounted on upper frame 58 via extending piece 66 and pivotal curved bracket 68, and is biased against belt 24*a* by spring 70 attached to pivotal piece 68. The gripping roller 64 assures positive contact of blank 62 with the moving underlying belt 24*a*. As such, the blank 62 will be moving at the belt speed prior to being gripped between opposed belts 24*a*, 24*b*.

The first transport segment 16 extends away from the cutter blank exit point 60 at a relatively shallow angle, depending on the conveyor clearance necessary to transport the blanks to their entry point at an ajoining unit. The relatively shallow angle alleviates the possibility of blank mutilation or deformation at the transition between the cutter unit and the conveyor. To increase transporting capacity of conveyor 10 and to assure a smooth transition from cutter 12 to conveyor 10 it may frequently be desirable to overlap or shingle the blanks as they move onto the conveyor 10. Two open-ended tubes 74, 76 provided between cutter 12 and transport segment 16, and which terminate just below blank exit point 60 on cutter 12, are provided to facilitate such overlapping. A constant stream of air, under pressure, flows from tube 74 adjacent cutter 12 and diverts the leading edge of each blank 62, moving from cutter 12, upwardly and over the trailing edge of a preceeding blank 62. Each blank's trailing edge is drawn towards belt 24*a* by a suction drawn through the second tube 76.

The shingler or bridge segment 22 is adjacent transport segment 20, and serves to facilitate accurate blank entry into the envelope forming unit 14. The pair of horizontally extending conveyor support beams 78 (FIG. 4) which straddle the conveyor transport and bridge segments, support the conveyor 10 in a desired relation. The transport segments, for example, are secured to the beams 78 via support pieces 80 extending from the beams. In like fashion, bridge unit 22 includes a framework 82 and is attached thereby to beams 78. Bridge 22 is supported on the framework 78 independently of the transport segments, and is thus not physically connected thereto. The bridge segment 22 is thus independently driven from the envelope forming unit 14, and may have a different belt speed than the interconnected transport segments.

Figure 5:
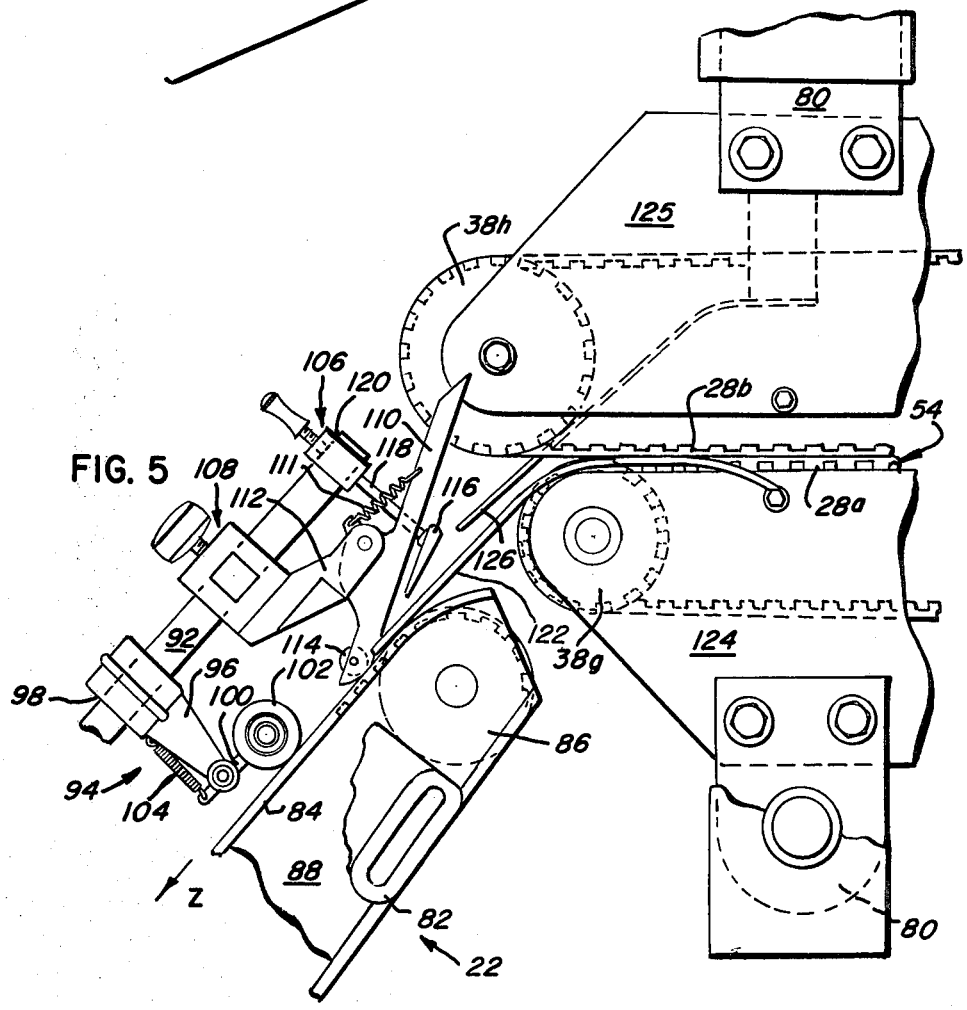
FIG. 5 is an enlarged fragmentary side elevational view of a portion of a third transport segment of the envelope conveyor and the adjacent bridge segment, with portions thereof shown cut away.

As best illustrated in FIG. 5, bridge segment 22 includes a single run of blank transport belts 84 on which the envelope blanks travel. The belts 84 extend around one end roller 86 carried in bridge frame 88, and a second end roller 90 (FIG. 2), through which the bridge segment is driven. A shaft (not shown) extends from the roller 90 and via a positive direct drive arrangement (not shown) is caused to rotate by the envelope forming unit 14. A mounting bar 92 extends along bridge 22, above and generally parallel to belt 84. The bar 92 is adapted to carry a plurality of biased gripping units 94 which maintain the blanks in position on belt 84. A support bracket 96 has a central opening 98 in one end through which the mounting bar 92 extends. An arm 100 is pivotally mounted on the lower end of bracket 96 and carries a gripping roller 102. A biasing spring 104, securely mounted on bracket 96 on one end, is attached at its second end to the opposite end of arm 100, and thereby biases gripping roller 102 into contact with underlying belt 84.

Also attached to mounting bar 92 are blank and gripper guides 106, 108 respectively. These guides are positioned along bar 92 to facilitate blank transition from the transport segment 20 to the bridge 22. A gripper guide 108 is positioned at each side of the bridge 22 (only one is shown) to direct each blank tip into contact with bridge belt 84. The gripper guide includes deflecting shoe 110 pivotally mounted on a support frame 112, and a gripping roller 114 carried in the deflecting shoe 110. The roller end of the deflecting shoe 110 is biased toward belt 84 by a spring 111 secured to frame 112 and shoe 110. Blank guide 106 includes an angled foot 116 which extends across a substantial portion of the side-to-side dimension of the bridge 22. The foot 116 is carried on a shaft 118 extending from a blank guide securing piece 120. As a blank moves from segment 20, the side edges of the blank are directed by shoes 110 toward bridge belt 84. To avoid blank buckling at the blank mid-section when this occurs, the blank guide 108 will urge the blank mid-section toward belt 84 simultaneously therewith. A lower wire guide 122 aids the blank movement through the transition between segments 20, 22, and is secured to the lower transport frames 124 of segment 20. So too, an upper wire guide 126 extends into the blank path 54 from between spaced-apart dual belts **28*b* in transport frame 125**, to aid in guiding the blank mid-section.

The timing relationship between the operating cycles of the two machine units 12 and 14 is important. The conveyor units are driven directly by the machines and maintain positive feed of the blanks at predetermined rates of travel over a fixed path. Thus, the linear positioning of each blank as the blank is fed to the conveyor unit 10 by unit 12 determines the positional relationship of the blank to the blank handling components of the unit 14 when discharged from the conveyor assembly to the latter unit. Accordingly, accurate calibration between each unit's operating cycle must be assured. Extending between the units 12, 14, and responsible for coordinating the envelope conveyor segments, is a calibrating drive shaft 130 (see FIG. 1, FIG. 7). The rotational position of the shaft 130 corresponds to a particular operational phase in the cycle of each unit. By securing the shaft portion 138, extending from blank cutting unit 12, in a predetermined rotational position relative to the shaft portion 140 extending from blank forming unit 14, the cyclical operation of each unit can be coordinated.

Figure 7:
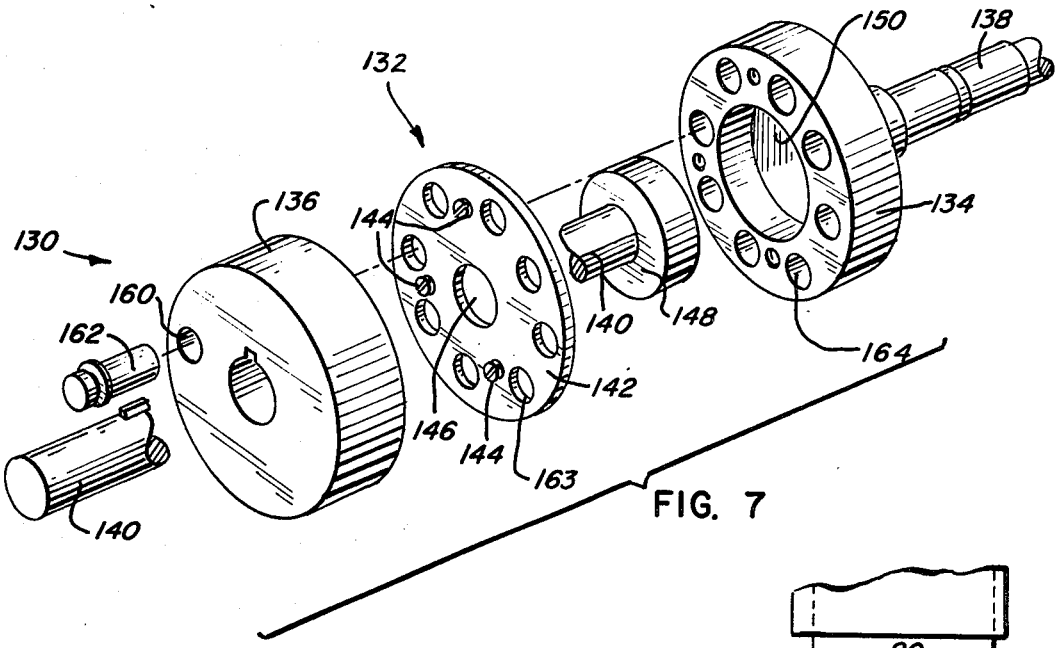
FIG. 7 is an enlarged perspective view of a presettable adjustable drive shaft connection associated with the invention, and shown in exploded relation.

FIG. 7 illustrates a synchronizing assembly 132 which may be used to achieve the desired relative positional relationship between shafts 138, 140. Faceplate 134 is attached to the end of shaft 138, while plate 136 is keyed to the shaft 140. The shaft 140 extends through the plate 136 and through the central opening of an interface plate 142, and terminates in an enlarged end piece 148 which is received in a cavity 150 of the plate 134. The plate 142 is attached to plate 134 by screws 144 and thereby traps end piece 148 in cavity 150, thereby securing the two shafts together longitudinally while accomodating slight universal or angular misalignment of the shaft axes and permitting rotational adjustment between the two shafts. Plates 134 and 142 are provided with eight aligned holes 163 and cavities 164, respectively, disposed at equiangular congruent circular spacings around opposed circular faces on each plate centered on the shaft drive axis.

Faceplate 136 is provided with a hole 160 along the periphery thereof, which is adapted to receive a pin 162 therethrough. The hole 160 through faceplate 136 is selectively alignable with any one of the eight holes 163, 164 in plates 142 and 134. Thus, pin 162 may extend through hole 160 and any one of the eight holes in interfacing plate 142 and into the corresponding cavity in faceplate 134, then in registry with hole 160. The rotational positional relationship between shafts 138, 140 can thus be set by adjusting faceplates 134, 136 and inserting pin 162 through hole 160 and corresponding holes 163, 164. Because a complete cyclical operation of each unit requires two revolutions of the shaft to which it is attached, the eight positions of adjustment of the synchronizing assembly 132 provide sixteen different relationships between the cycle of units 12 and 14, and thus of the delivery position of the blanks to unit 14.

In operation, envelope blanks 62 are cut from a continuous paper web 242 which is positioned, relative to cutter unit 12, to feed into the unit at an angle in a known manner. The blanks are cut from the web 242 along a line perpendicular to the edges 244 of the web 242, so that the blanks are substantially diamond-shaped and move with a corner extending forward. (See FIGS. 1 and 6). As each blank is cut, it is propelled toward cutter exit point 60 (FIG. 3) in a non-overlapping relation. A speed differential between the cutter 12 and opposed belts **24*a*, 24*b* in the first transport segment 16 causes envelope blanks leaving exit point 60 to overlap as they are drawn between the slower moving opposed belts 24*a*, 24*b*. The blanks are maintained in their predetermined overlapping position until they reach the end of the last transport segment 20. A second speed differential between transport segment 20 and bridge 22 slows the blank travel speed on the bridge and causes additional blank overlap. As located along the bridge 22, the blanks are in proper relative position to be fed into the forming unit 14 in proper positional relation with the initial blank transport and manipulating components thereof. The accurate relative position of blanks entering the forming unit 14 is necessary to insure properly coordinated engagement by the initial blank engaging components of this unit. Thereafter, appropriate timed operations are performed on each blank by the unit 14. Such operations include window cutting, printing and folding, shown generally at 150**.

Thus, an envelope assembly is provided that is of simplified design and construction, and yet is capable of transporting envelope blanks between individually functioning, high-speed units of an envelope assembly. It will be appreciated that it is an important purpose of this invention to establish the proper "timed" relationship between envelope blanks as they leave the cutter unit, and to insure accurate positional relationship as each blank enters the folding unit. The envelope conveyor is also adaptable to a variety of individual units, and yet may be removed from the units so that they may be utilized in other capacities.

While a particular embodiment of the invention has been shown, it will be understood that the invention is not limited thereto since modifications may be made and other embodiments of the principles of this invention will occur to those skilled in the art to which the invention pertains upon consideration of the foregoing teachings. It is, therefore, contemplated by the appended claims to cover any such modification and other embodiments as incorporated those features which constitute the essential features of this invention within the time spirit and scope of the following claims.

I claim:

1. An improved envelope forming assembly comprising, in combination, a first device having at least a blank exit position, a second device having at least a blank entry position, said blank exit and blank entry positions on said respective devices being inaccessible for direct blank feeding from said first device to said second device, a blank transporting member interconnecting said devices facilitating blank transfer therebetween, wherein at least a portion of said blank transporting member is driven by one of said devices, and means for synchronizing the operation of said first and second devices whereby movement and positioning of envelope blanks in transit from said first device to said second device may be accurately regulated.

2. The assembly of claim 1, wherein said transporting member is removably mounted between said first and second devices, and is adapted to interconnect a variety of envelope forming devices.

3. The assembly of claim 1, wherein said first device is adapted to drive a first portion of said transport member.

4. The assembly of claim 3, wherein said second device is adapted to drive a second portion of said transport member.

5. The assembly of claim 4, wherein said first device is driven from said second device.

6. The assembly of claim 5, wherein said means for calibrating the operation of said first and second devices is a calibrated and adjustable drive shaft extending between said first and second devices.

7. The assembly of claim 6 wherein said adjustable drive shaft includes a shaft portion extending from each device and means for selectively predetermining the angular position of said drive shafts relative to one another, whereby the relative angular position of said shafts directly determines the cyclical relation between said devices.

8. The assembly of claim 1, wherein said first device is a continuous feed paper web blank cutter and is adapted to drive a first portion of said transport member.

9. The assembly of claim 8, wherein said second device is a mid-entry continuous-operation envelope folding device and is adapted to drive a second portion of said transport member.

10. The assembly of claim 9, wherein said first device is driven from said second device.

11. An improved envelope forming assembly comprising in combination, a continuous paper web envelope blank cutter device and a second continuous-operation, mid-entry, blank receiving envelope forming device, an elevated blank transport unit intermediate the cutter device and second device capable of transporting envelope blanks to said second device from said blank cutting device within predetermined intervals and in position for proper entry into said second device, and a calibrated drive means for correlating the operation of the blank cutter device and second envelope device, such that movement and position of each envelope blank produced by said blank cutter device and in transit to said second envelope device may be accurately regulated or adjusted.

12. The improved envelope forming machine of claim 11, wherein said blank transport unit comprises segmented conveyor sections being driven from said blank cutter device, whereby blank transport speed is related to blank cutting speed.

13. The improved envelope forming machine of claim 12, wherein said conveyor sections are of an opposed belt feeder type and are thereby provided to maintain said transported blanks in their predetermined spaced relation.

14. The machine of claim 13, wherein said belts are of uniform thickness and are disposed, by opposed pressure rollers along said belts, into a sinusoidal path.

15. The machine of claim 12, wherein a predetermined number of said segmented conveyor sections are driven from said second envelope device whereby said transported blanks are accurately fed into said second device.

* * * * *